US005499645A

United States Patent [19]

Baliga

[11] Patent Number: 5,499,645

[45] Date of Patent: Mar. 19, 1996

[54] DUAL STAIR STEP WALKER WITH ASSIST BAR

[76] Inventor: Arvind B. Baliga, 405 Valley Forge Ct., Medford, N.J. 08055

[21] Appl. No.: 500,801

[22] Filed: Jul. 11, 1995

[51] Int. Cl.[6] ..... A63H 3/00

[52] U.S. Cl. ..... 135/67; 135/77

[58] Field of Search ..... 135/65, 66, 67, 135/75, 77; 482/66, 68, 69; 297/5, 7; 280/87.021, 87.041, 87.051

[56] References Cited

U.S. PATENT DOCUMENTS

| | | | |
|---|---|---|---|
| 2,656,874 | 10/1953 | Robb | 155/22 |
| 2,785,731 | 3/1957 | Welsh | 155/22 |
| 3,421,529 | 1/1969 | Vestal | 135/67 |
| 4,044,784 | 8/1977 | Smith . | |
| 4,094,331 | 6/1978 | Rozsa . | |
| 4,601,302 | 7/1986 | Breen et al. | 135/66 |
| 4,786,082 | 11/1988 | Swietlik . | |
| 4,867,438 | 9/1989 | Steckert . | |
| 4,869,279 | 9/1989 | Hedges . | |
| 4,941,496 | 7/1990 | Berning . | |
| 5,217,419 | 6/1993 | Harwood . | |

*Primary Examiner*—Lanna Mai
*Attorney, Agent, or Firm*—Abdallah & Muckelroy

[57] ABSTRACT

An integral stair climber, lifter, bracer and walker includes a frame which has a pair of spaced apart upright struts or members. A cross piece extends between the upright members two-thirds of the distance up the upright members. A handle portion is attached to the upright members at the upper end thereof. The handle portion includes a pair of opposed, vertically disposed segments which are receivable on the upright members. A grip pair is located on top of each vertically disposed segment and includes two grips, one located posteriorly to a vertically disposed segment and another extending anteriorly to the vertically disposed segment. A transverse element extends between the two vertically disposed segments or struts. Each anteriorly located grip is connected between the transverse clement and the vertically disposed segment. A four-footed base is located on the lower end of each upright member and is orthogonal thereto. Each base includes a plate to which four feet are attached and which is fixed to the upright member. Each anteriorly located grip is tilted upwards at approximately a 45 degree angle and slightly inwards towards the transverse element at approximately a 25 degree angle.

3 Claims, 4 Drawing Sheets

DUAL STAIR STEP WALKER WITH ASSIST BAR

BACKGROUND OF THE INVENTION

1. Field of the Invention

This invention relates to orthopedic walkers or supports, and more particularly to a supporting walker for helping or aiding a human to walk, provide a rest support while standing in place.

2. Description of the Prior Art

With the increases in life expectancy which have resulted from medical advances, a larger proportion of the world's population lives to an advanced age. As a result, there are now a larger proportion of aged and infirm people than there were previously.

Aged or infirm persons have needs which are different than those of the general population. In particular, aged and infirm persons may frequently require the assistance of a special device in order to walk up and down stairs with safety. This is especially true for homes and residences in the northeastern United States which are predominantly multiple level dwellings. Among such devices, which are known to the prior art are a number of multiple legged walking aid canes in which the base of the cane is broadened by the addition thereto of four legs which provide a firmer base for the cane to prevent the user from falling.

In previous walking aid canes, the leg members of the cane have generally projected upwardly and inwardly at an angle from a supporting surface with the leg members connected at their upper ends to an upwardly extending central support post. The legs of such canes formed what may be termed a pyramidal configuration. While such canes have been somewhat satisfactory, they have suffered from a number of drawbacks. With the cane legs forming a pyramidal configuration, the center of gravity of the cane is relatively lower so that the cane may not be as easily tipped over to permit falling of the user. The pyramidal configuration of the cane legs has interfered with the user's foot and leg movements with the user's foot in close proximity to the cane. The prior art structure has the base positioned inside between the user's feet near one or the other depending on whether the user is left or right handed. The potential of the pyramidal base is therefore not fully exploited.

To avoid interference of the cane with his foot movement, the user is forced to position the cane in front of his body. This is generally unsatisfactory since the supporting force provided by the cane is then directed upwardly and slanted towards one of the user's arms and its adjacent shoulder. Rather, the supporting force provided by the simple pyramidally based cane will be angled upwardly in a direction toward the user's body such that the force applied by the user to the cane will have a side force component directed away from the user's body. The side force component will have a tendency to tip the cane and to permit the user to fall when combined with the fact that the singular cane is located near one foot and in front and toward the center of the user's body.

Some of the individuals with physical ailments have to some degree benefited by the use of invalid walkers now available to them. The U-shaped walkers are generally quite conspicuous in restaurants, malls, rest homes and other public establishments. Thus these walkers have opened up a world to many individuals who would otherwise be homebound. Their mobility has greatly increased and along with this the pleasures of everyday living.

The U-shaped walkers have been available for many years. For example, U.S. Pat. Nos. 3,517,677 and 3,945,389 show the typical U-shaped walkers. U.S. Pat. No. 3,517,677 shows a design which permits relative rotation of the two side frames to permit usage of the walker on uneven surfaces. U.S. Pat. No. 3,945,389 shows a U-shaped walker with a transverse member and braces which permit the user to conveniently fold the walker when not in use.

Moreover, in order to provide some handicapped individuals with stair climbing ability, walker aids have been incorporated into canes and crutches to facilitate this type of physical movement. Thus, U.S. Pat. No. 3,387,618 discloses improvements to crutches and cane which permits the user to ascend and descend stairways. U.S. Pat. No. 4,094,331 shows a walking frame of novel design which presumably can be used on level surfaces as well as stairways. Thus, it has been the meritorious objective of inventors in this field to provide handicapped individuals with equipment which to a large extent avoids a life in wheelchairs, rest homes or hospital beds. This has been accomplished to some degree by the use of U-shaped walkers. Now the present invention provides the user with a walker which provides a novel combination of features and efficient elimination of unnecessary elements and which is highly functional.

SUMMARY OF THE INVENTION

The lighter weight and overall design of this novel integral stair climber, lifter, bracer and walker permits easy manipulation by the user on stairs without loss of support or stability. The double spaced apart vertical struts interconnected with a horizontal forward extending U-shaped connecting member, each strut constructed with four-footed support platform also permits the accommodation of the varied needs of the user.

OBJECTS OF THE INVENTION

In providing a solution to the deficiencies of previous walking aid canes as well as walkers, it would be desirable to have an integral stair climber, lifter, bracer and walking aid walker in which the configuration of the leg members provided a walker with a low center of gravity centered in front of the user. Such a walker would be more difficult to tip over when used to assist in standing and navigating stairs and would, thus, provide firmer support to an aged or infirm user. Also it would be desirable to provide a walking aid walker in which shape and the position of the leg members was such that the walker could be placed more closely adjacent to the user's foot and leg without interfering with the user's forward movements. Such a walker would be safer since there would be less tendency for the user to trip and to fall when walking forward and when attempting to stand up.

It would also be desirable to provide a walking aid walker in which the walker legs make contact with a supporting surface over a larger frictional area. Such a walker would provide greater frictional engagement between the extremities of the legs and a supporting surface to prevent slippage of the walker with respect to the supporting surface. Additionally, it would be desirable to have a walking aid walker in which the handle member could be released and a cross bar used with one or both hands for either walking, resting while standing, or to assist in standing up.

Thus a first object of the invention is to provide a combination of a lifter, bracer, and walking support member especially for use by persons who have been injured or crippled whereby the support member of the present invention will facilitate or permit such persons to move about more easily, retain support while partially bent over, climbing stairs, and obtain assistance in standing up from a sitting position.

Another object of the invention is to provide a support member that can be made of lightweight material and wherein in one form of the invention the elevation or height of the support member can be adjusted, to adapt the device to persons of various height or size, the support member including two multiple point lower ends located to the side of the user whereby a sturdy support is provided at any position along the front of the user.

A further object of the invention is to provide an integral stair climber, lifter, bracer and a support structure that is simple and inexpensive to manufacture.

These objects and other objects and advantages of the invention will be apparent from the following description.

Other objects and advantages will be apparent during the course of the following description.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1A:
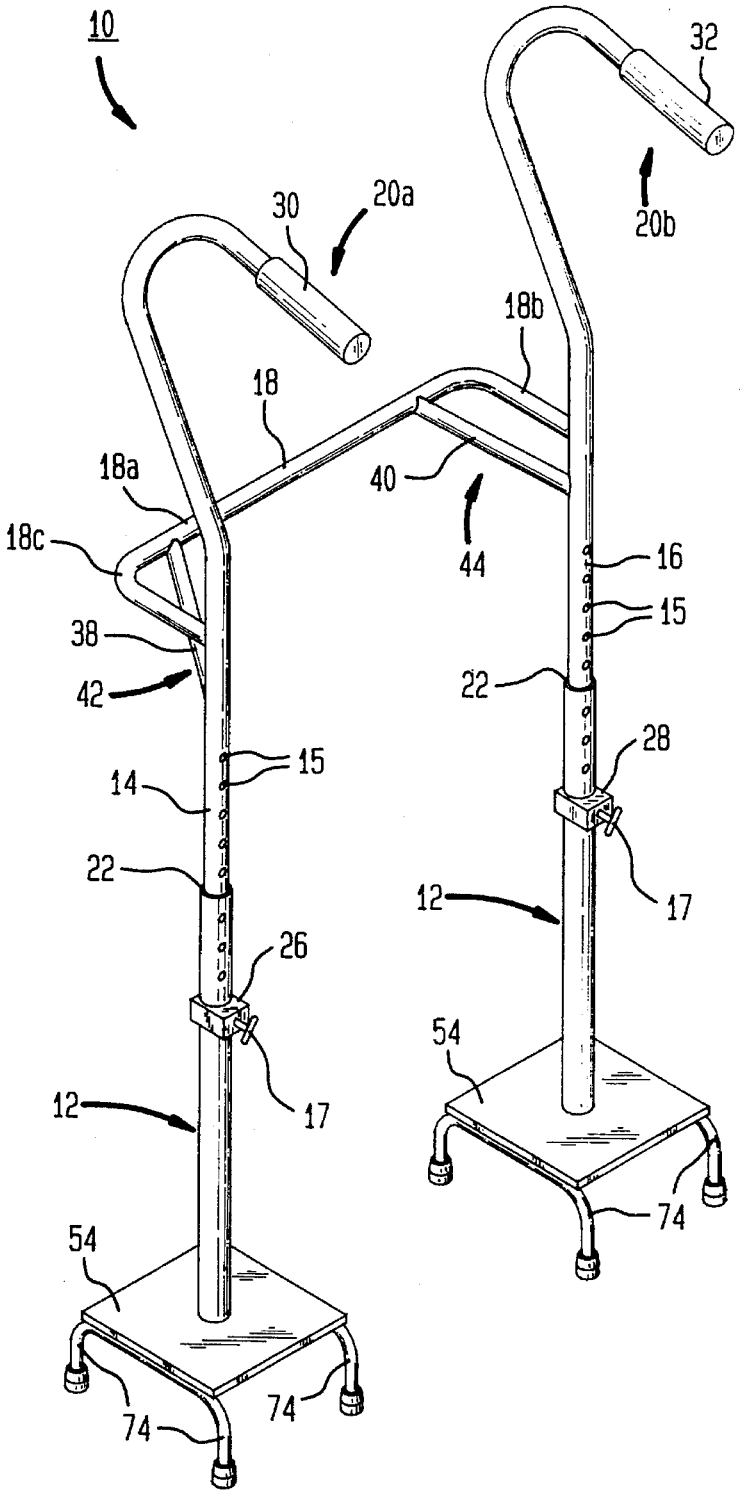
FIG. 1A is a right side elevation view of an embodiment of the novel dual walker according to the novel invention.

Referring in detail to the drawings, in particular FIG. 1A, FIG. 2, FIG. 3, and FIG. 4, in the Figures the numeral 10 designates a preferred embodiment, the novel walker 10, which can be made of any suitable material such as lightweight steel or aluminum metal tubing. The walker 10 includes a pair of support members 11 and 12 that are arranged parallel with respect to each other and vertical from the floor. There is further provided a pair of standards 14 and 16 for coaction with each of the support members 11 and 12. Each of the support members 11 and 12 is provided with enlarged hollow sockets 22 and 24, respectively, on the upper end which slidably engage the lower ends of the posts 14 and 16. A pair of locking means 26 and 28 (see, FIG. 1B and FIG. 1C) is provided for maintaining the standards 14 and 16 immobile in their adjusted positions on the support members 11 and 12. This means comprises a plurality of apertures 15 or openings which are vertically aligned and arranged in each of the standards 14 and 16. The apertures 15 are mounted for movement into and out of registry with a pair of diametrically opposed apertures or openings in the upper end of each of the support members 11 and 12. These opposed apertures are not shown because they are covered by clamps 26 and 28. A suitable securing element which may be a bolt 17 in each of the clamp 26 and 28 extends through the registering apertures 15, and the bolt 17 (see, FIG. 1B) includes a finger engaging portion and a shank that is threaded for firm engagement with the apertures 15 which are also threaded to receive the bolt 17 extending through apertures (not shown) in the tube walls of the support members 11 and 12.

Figure 1B:
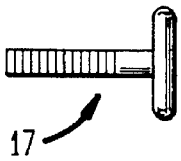
FIG. 1B is a view of a threaded locking bolt.
Figure 1C:
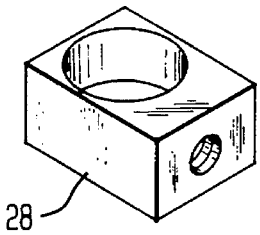
FIG. 1C is a perspective view of a threaded locking blocking adapted to receive the bolt shown in FIG. 1B.

There is further provided a pair of handles 20*a* and 20*b* adapted with handgrips 30 and 32, as shown in FIG. 1A. A bracing cross member 18 extends between the upper ends of the standards 11 and 12. The member 18 is located a substantial distance below the handles 20*a* and 20*b* to allow free access thereto and so as not to interfere with gripping of the handles 20*a* and 20*b*. The cross member is located substantially lower than the handles 20*a* and 20*b* to provide a supplemental grip means to a user while bending over or stooped over in a resting position. It has been found that older persons when winded or tired feel as if they can recover or rest better temporarily by partially bending forward. The substantially lowered height of the member 18 allows the user to bend over by holding onto this member 18 and letting go of the grips 30 and 32.

The member 18 comprises a transverse portion 18*a* and two forwardly extending portions 18*b* and 18*c*. The portion 18*b* is attached to the standard 14, for example by welding. The portion 18*c* is attached to the standard 16, for example by welding. The member 18 is further secured and stabilized by under supports 38 and 40 which extend from the portion 18*a* of the member 18 to standards 14 and 16, respectively, and are attached permanently, for example, by welding at each end.

Figure 2:
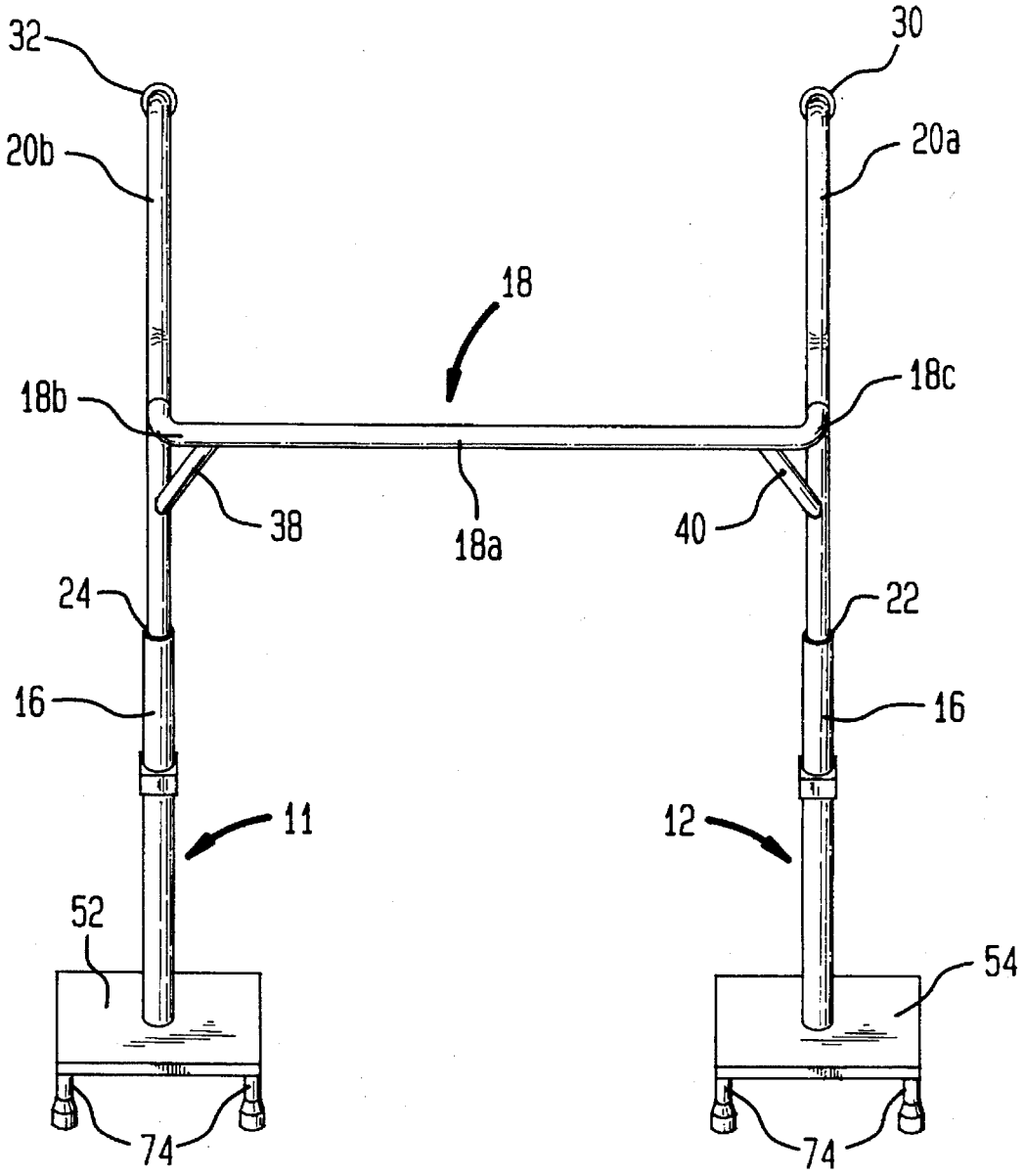
FIG. 2 is a front elevation of the novel dual walker of FIG. 1A.
Figure 3:
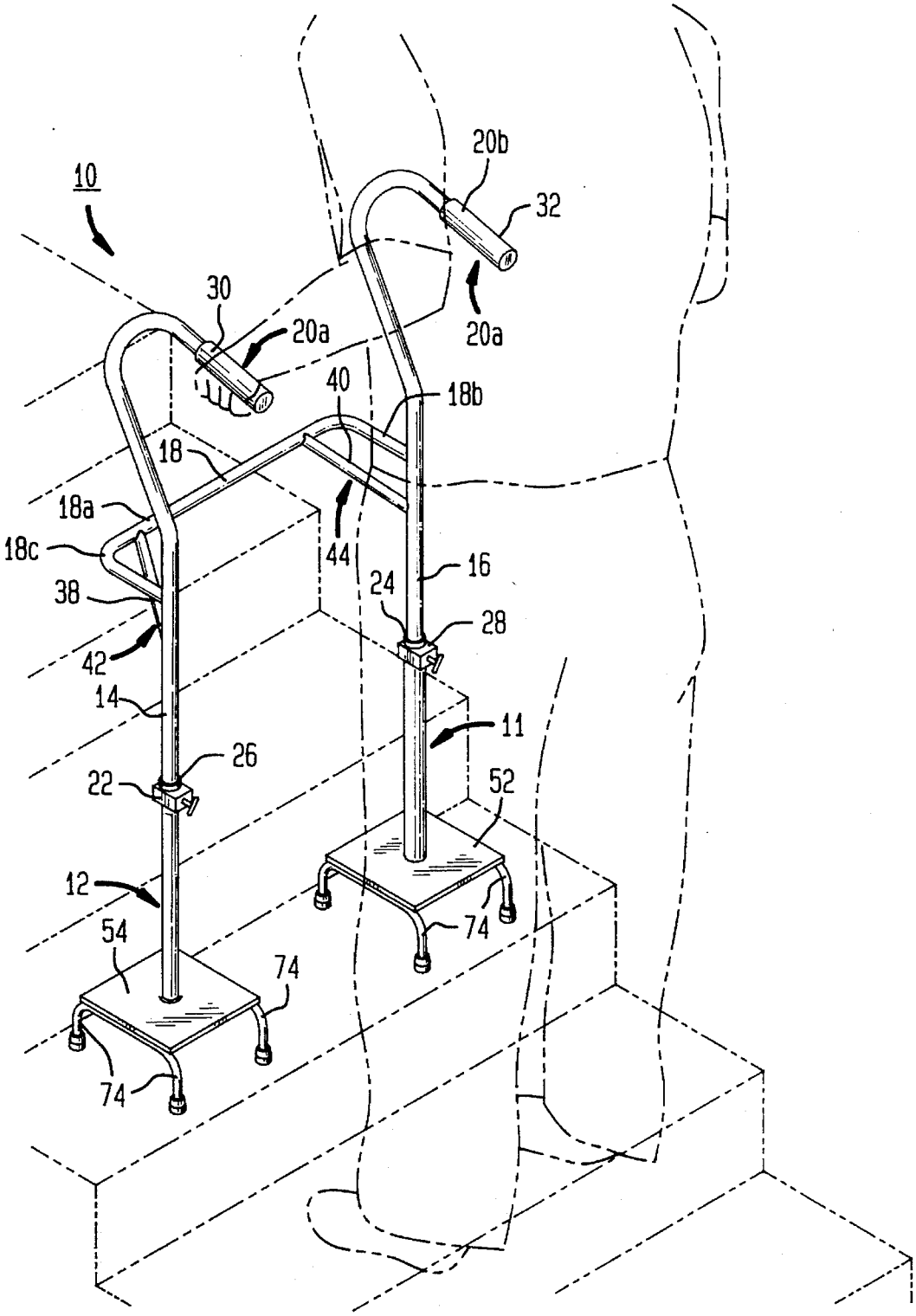
FIG. 3 environmental view depicting use of the novel dual walker on stairs.
Figure 4:
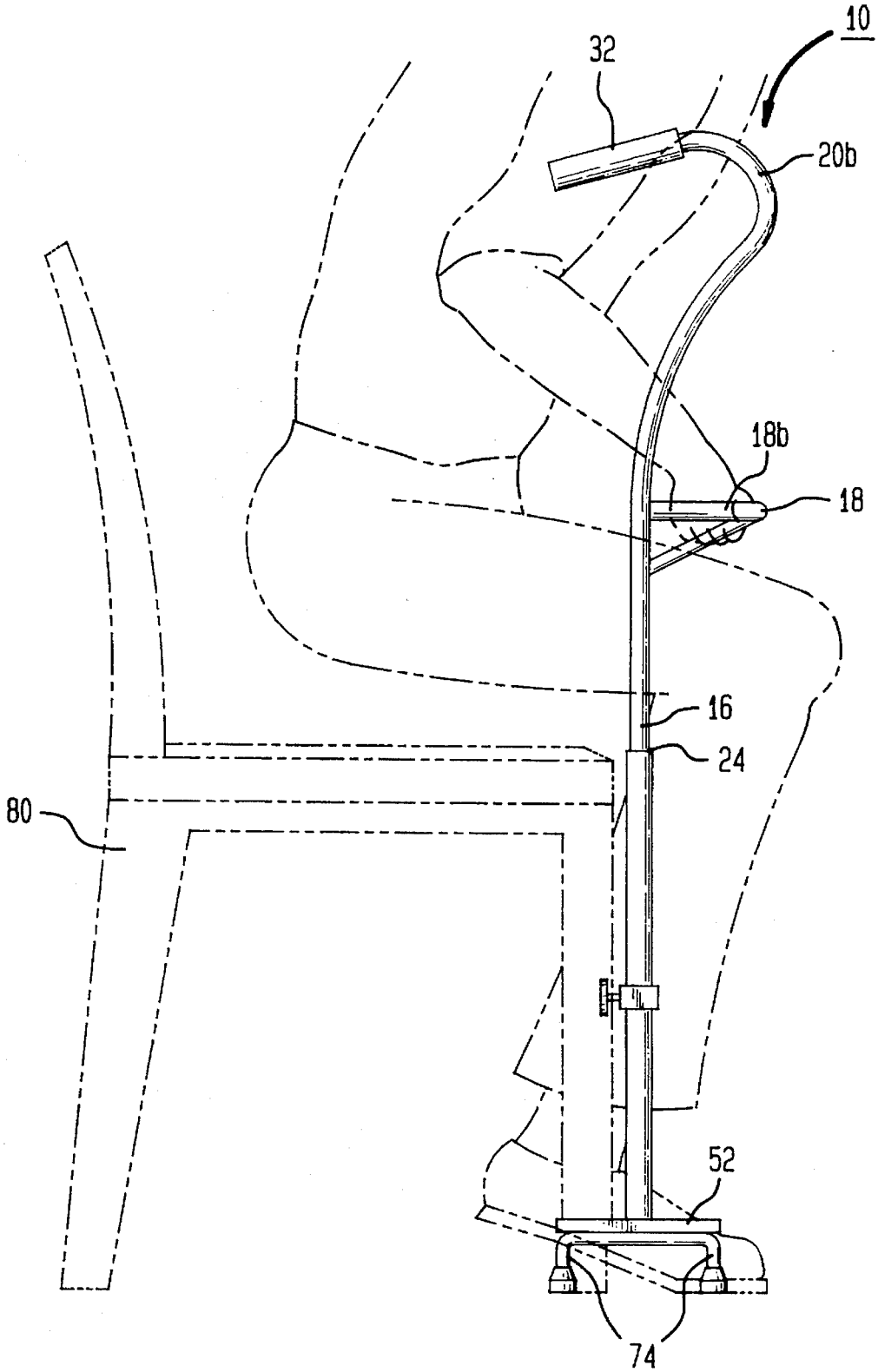
FIG. 4 is an environmental view of the novel dual walker as same is used for assisting the user in rising out of a chair.

As further shown in FIGS. 2, 3, and 4 each of the support members 11 and 12 is rigidly secured to rectangular plates 52 and 54, respectively. Welded to each of the plates 52 and 54 is a foursome of outer legs 74. The outer legs 74 comprise two pairs of legs with each pair connected via a horizontal tubular portion welded to one of the plates 52 or 54. Extending vertically from the plate 52 is the support member 11. Extending vertically from the plate 54 is the support member 12. The support member 11 and 12 are permanently attached to their respective base plates, for example by welding. As further shown in FIG. 2 the support members 11 and 12 are each tubular structures with a inside diameter greater than the outside diameters of the standards 14 and 16 such that the support members 11 and 12 slidably engage standards 16 and 14, respectively.

To minimize slippage on slippery surfaces the legs 74 are each adapted with a fitted slip-on foot pad, preferably of elastomeric material.

Referring to FIG. 3 it is apparent that the dual walker 10 is especially suitable or useful for persons who require an aid to walking up stairs. Moreover, as shown in FIG. 2 the dual walker 10 with the assist bar or horizontal fixed cross member 18 provides a competent aid to standing from a seated position in a chair 80, for example. The dual walker 10 allows the user to grasp grips 30 and 32 and claim stairs as shown in FIG. 3 or walk about or move about. When climbing stairs as shown in FIG. 3 the horizontal bar or member 18 is used to lift the dual walker 10 using an underhanded curling movement engaging both the forearm and biceps. This has been found vastly easier that lifting the walker using only the handle grips 30 and 32. Thus, many persons afflicted with crippling injuries or diseases such as polio, whereby diminution in the use of one or both limbs results are helped by the dual nature of this walker which enables the cross bar to assist in lifting oneself, lifting the walker on stairs, and in bending over and being supported while resting during the course of a walk.

Also, the device may be constructed of materials such a fiberglass or carbon filaments to lighten its weight to further increase its transportability on stairs.

The dual walker 10 shown in FIG. 1 is adjustable as to height by selecting a particular threaded aperture 15 to be engaged by the threaded bolts 17 screwed there into via the mounting blocks 26 and 28. The present invention will enable a person such as one who has been injured or crippled, to walk safely. Thus, in the event a person suffers a stroke which leaves him or her without the use of his or her legs, the walker of the present invention will permit the person to take beneficial exercises since these walkers will permit the person to walk safely.

What is claimed is:

1. A combination comprising an integral stair climber, lifter, bracer and walker comprising a pair of posts arranged in a vertical parallel relationship with respect to each other, said posts each having an upper end and a lower end, each upper end having an intermediate portion bent forward at approximately a 45 degree angle and an end bent horizontal and covered with a resilient grip, and said walker further comprising a pair of standards, each said lower end adjustably telescopically engaging said corresponding standard, said pair of posts being of the same size, each standard having an enlarged socket at its upper end for telescopically receiving the lower end of said post, there being a plurality of spaced apart registering apertures in each said standard and in each said post, a first securing element extending through said registering apertures in one of said standards and corresponding post and including an enlarged finger engaging portion on an end thereof: a second securing element extending through said registering apertures in the other of said standards and corresponding post and including an enlarged finger engaging portion on an end thereof, a horizontally disposed U-shaped handle extending between the upper ends of said standards and protruding forward in a horizontal plane and secured thereto, a pair of spaced apart support members, one depending from each side of said handle and arranged to extend below said U-shaped handle and permanently connect said handle to a nearby post, the walker further comprising a pair of metal plates, one plate connecting the lower end of one of said standards to a foursome of legs each having lower straightened portions arranged in a substantially equally spaced apart relation with respect to each other, the other plate connecting the lower end of one of said standards to another foursome of legs each having lower straightened portions arranged in a substantially equally spaced apart relation with respect to each other, each said foursome of legs being of the same size, the upper portions of said legs being curved and being secured to said plates, and a horizontally disposed bottom brace extending between pairs of said legs and secured to the plate, said bottom brace being positioned below said plate, said bottom brace lying in the same plane as said legs, said bottom brace being longer than said handle, and resilient cups mounted on the lower end of said legs.

2. The combination of claim 1 further comprising a first engaging means for engaging and retaining said first securing element in an aperture in said first standard and a second engaging means for engaging and retaining said second securing element in an aperture in said second standard.

3. The combination of claim 2 wherein said apertures are threaded and adapted to threadedly receive said first and second securing elements.

* * * * *